US005454740A

United States Patent [19]

Sakano et al.

[11] Patent Number: 5,454,740

[45] Date of Patent: Oct. 3, 1995

[54] CONNECTOR WITH TERMINAL LOCKING SPACER

[75] Inventors: Masahiro Sakano, Ebina; Minoru Sano, Hachioji, both of Japan

[73] Assignee: Molex Incorporated, Lisle, Ill.

[21] Appl. No.: 300,603

[22] Filed: Sep. 2, 1994

[30] Foreign Application Priority Data

Sep. 16, 1993 [JP] Japan ..... 5-253751

[51] Int. Cl.[6] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| Re. 34,539 | 2/1994 | Aoyama | 439/752 |
| 4,891,021 | 1/1990 | Hayes et al. | 439/752 |
| 4,946,398 | 8/1990 | Takenouchi et al. | 439/599 |
| 5,071,373 | 12/1991 | Nagasaka et al. | 439/752 |
| 5,145,419 | 9/1992 | Yamanashi et al. | 439/752 |
| 5,292,261 | 3/1994 | Hirano et al. | 439/752 |
| 5,308,265 | 5/1994 | Kaneko | 439/752 |

*Primary Examiner*—Gary F. Paumen
*Attorney, Agent, or Firm*—A. A. Tirva

[57] ABSTRACT

Disclosed is an improved electrical connector having at least one detachable spacer. The spacer is positioned so as to leave a space large enough for terminals to be inserted into the connector housing without interference with the overlying spacer or the spacer is adapted to float in response to the insertion of terminals after the terminals are located in the final terminal setting position. The spacer is moved into the final spacer mounting position, in which position latching projection of the locking arms of the spacer are fitted into the slots of top wall of the housing and at the same time, latching projections lock the underlying terminals, in the connector housing. To remove the spacer and hence the terminals from the connector housing it suffices that the spacer is raised up by its front edge to rotate until the latching projections are released from the slots. In the electrical connector no load is applied to terminals by the overlying spacer when the terminals are inserted and moved to the final terminal-mounting positions minimizing incomplete mounting of the terminals. All the locking arms of the spacer apply equal holding forces to the terminals; and rotating of the spacer permits removal of the spacer (and hence the terminals) from the connector housing without requiring extra tools.

4 Claims, 6 Drawing Sheets

CONNECTOR WITH TERMINAL LOCKING SPACER

BACKGROUND OF THE INVENTION

1. Field of the Invention

The invention relates to an electrical connector having at least one detachable spacer to lock electrical terminals inserted in terminal-receiving cavities to prevent the terminals from being pulled out of the connector housing.

2. Description of the Prior Art

Electrical connectors having detachable spacers are known in the art. In one typical application a detachable spacer is provisionally inserted in a connector in the space defined between a top wall of the housing and the terminal receiving cavity. Terminals are then inserted into the terminal receiving cavities passing under the overlying spacer to the final terminal mounting position. The spacer is then moved forward until it has reached the final spacer mounting position locking the terminals in place.

One example of such locking spacer used with an electrical connector is proposed in Japanese Utility Model Application, Public Disclosure No. 63-56573.

The detachable spacer has a plurality of resilient latching arms extending from its base and two locking projections extending from each side of the spacer. The connector housing has two slots on each side wall adapted to receive the two locking projections of the spacer. First, the spacer is moved into the housing until the locking projection on each side of the spacer has been engaged by the respective slot of each side wall of the housing. This constitutes the spacer's primary mounting position. The terminals are then inserted into the terminal cavities while abutting the resilient arms of the overlying spacer until the terminals reach the final terminal-mounting position. Thereafter, the spacer is moved to its final spacer-mounting position at which time the latching arms apply a pushing force to the terminals locking the terminals in the housing. In this final spacer-mounting position the two locking projections of each side of the spacer are engaged by the two slots of each side wall of the housing. To remove the spacer from the housing, it is necessary to expand, with the aid of a tool, the two opposite side walls of the housing wide enough to allow the two locking projections of each side of the spacer to be released from the slots in each side wall of the housing. After the spacer is removed from the housing, the terminals may also be removed.

The above described connector has the following disadvantages:

First, the terminals are subjected to a force applied by the latching arms of the overlying spacer while being inserted into the connector housing until they have reached the final terminal-mounting position, and therefore it is possible that the terminals may not be fully seated in the terminal-receiving cavities.

Second, because each of the latching arms of the spacer are not independently latched to the connector housing but rather the base of the spacer is locked to the housing, the terminal holding force of each locking arm mounted in the housing depends on the number of terminals mounted in the housing.

Third, a tool is required to expand the connector housing to release the locking projections of the spacer from the two slots in each side wall of the housing allowing removal of the spacer from the connector housing.

SUMMARY OF THE INVENTION

One object of the present invention is to provide an electric connector having at least one detachable spacer which allows low force insertion of terminals thereby minimizing incomplete mounting of terminals in the electrical connector.

Another object of the present invention is to provide an electric connector having at least one detachable spacer having a plurality of locking arms wherein each locking arm applies the same locking force to a respective terminal.

Still another object of the present invention is to provide an electric connector having at least one detachable spacer which does not require a tool for removal from the connector housing.

According to the present invention an electrical connector includes at least one detachable spacer which when mounted in the housing prevents terminals from being pulled out of the housing once the terminals have been moved to their final mounting position. The spacer is positioned within the connector so as to leave a space large enough for the terminals to move to their final mounting position without interfering with the overlying spacer. The spacer has a base, guide projections integrally connected to its opposite sides and a plurality of locking arms integrally connected to the rear edge of the base and terminating with projections extending from the arms. The top wall of the connector has a plurality of tapered engagement pieces to engage the locking arm projections when the spacer is brought to the primary position and a plurality of slots to engage the latching arms projecting when the spacer is moved from the primary position to the final spacer-mounting position without interfering with the terminals. Guide slots are present in the opposite side walls of the top wall to guide the guide projections of the spacer when moving from the temporary position to the final spacer-mounting position. The guide projections and the guide slots being so constructed so as to allow the guide projections to slip off the guide slots allowing the spacer to be rotated about the rear edge of the base thereby releasing the latching arm projections from the slots.

BRIEF DESCRIPTION OF THE DRAWINGS

Other objects and advantages of the present invention will be understood from the following description of electrical connector according to preferred embodiments of the present invention, which are shown in accompanying drawings.

DESCRIPTION OF THE PREFERRED EMBODIMENT

Figure 1:
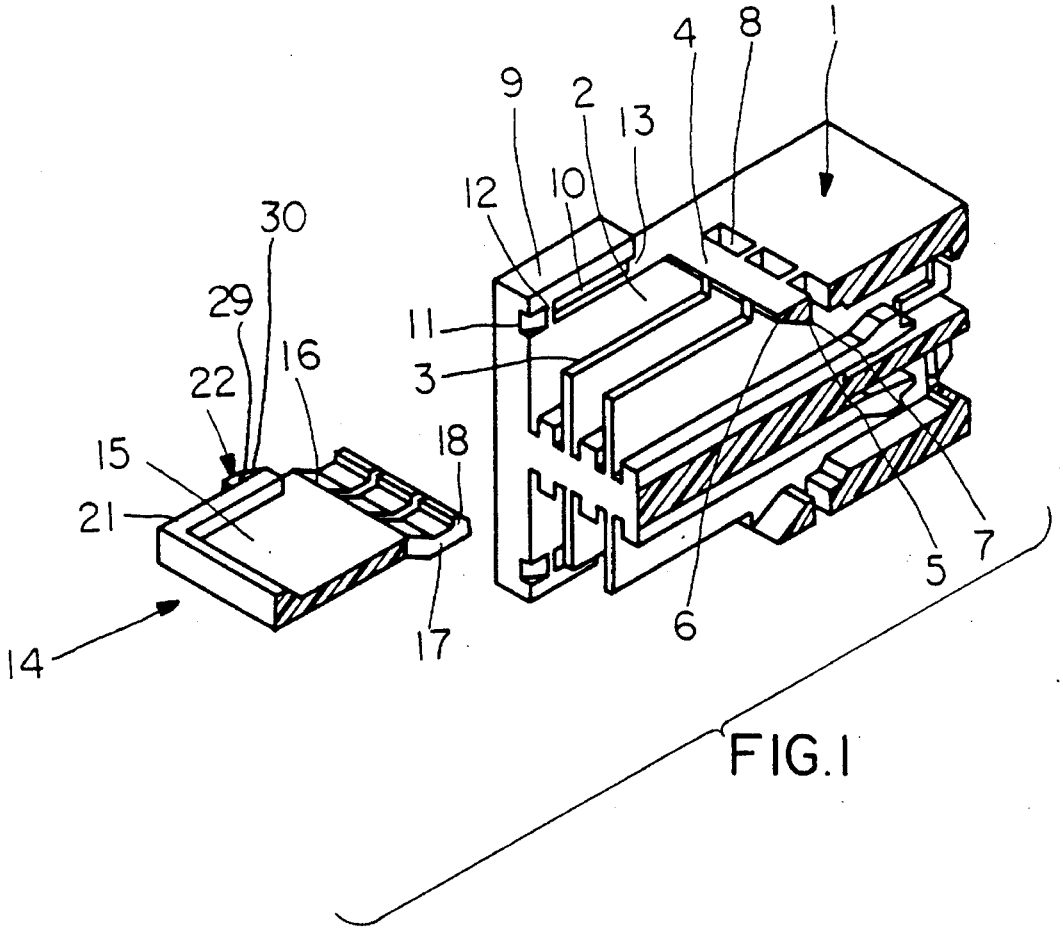
FIG. 1. is a partial perspective view of an electrical connector housing and a detachable spacer.

FIGS. 1 to 10 illustrate an electrical connector with two detachable spacers according to one embodiment of the present invention.

As shown, connector housing 1 has a plurality of terminal mounting spaces or compartments 2 arranged laterally and defined by partitions 3.

A top wall 4 covers the rear half (mating end) of the housing leaving the front half of the housing exposed. The top wall 4 has a lateral engagement piece 5 integrally connected to the front edge of the lower surface of the top wall 4. the lateral engagement piece 5 has an angled front surface 6 and an adjacent flat surface 7. The flat surface 7 inclines up towards the rear. A plurality of engagement slots 8 are located in the top wall in alignment with the terminal mounting compartments 2. Side walls 9 are integrally connected to the opposite sides of the top wall each side wall 9 includes a guide slot 10 and an inlet slot 11 separated by a stopper section 12. the guide slots 10 are open on their outlet sides 13.

A detachable spacer 14 has a base 15 and a plurality of locking arms 17 integrally connected to the rear edge 16 of the base 15 terminating in latching projections 18. Two spacers 14 are used for insertion in the upper and lower terminal mounting spaces 2. The spacer 14 which is inserted in the upper terminal mounting spaces 2 is described hereinafter, however, when occasion demands, the spacer 14 to be inserted into the lower terminal mounting spaces may be also described.

The spacer 14 has as many locking arms 17 as there are terminal mounting compartments 2, and hence terminals 23. Each locking arm 17 comprises an angled extension 19, an adjacent horizontal extension 20 integrally connected to the angled extension 19 and an up-rising latching projection 18 integrally connected to the end of a horizontal extension 20. The base 15 of the spacer 14 has a circumferential edge frame 21 integrally connected to the opposite and front sides of the base 15. Guide projections 22 are integrally connected to the opposite sides of the circumferential edge frame 21.

Each guide projection 22 is tapered rearward as indicated at 30 and is tapered upward as indicated at 29.

A terminal 23 to be fitted in a selected terminal mounting compartment has a rear contact section for engaging a pin terminal (not shown) on its rear side (rightward in FIGS. 2 to 5) and a front connecting section to be connected to a wire (not shown) on its front side (leftward in FIGS. 1 to 5).

The method of mounting terminals 23 and the spacer 14 in the upper terminal mounting spaces 2 of the housing 1 of the electric connector according to the first embodiment is described below.

Figure 2:
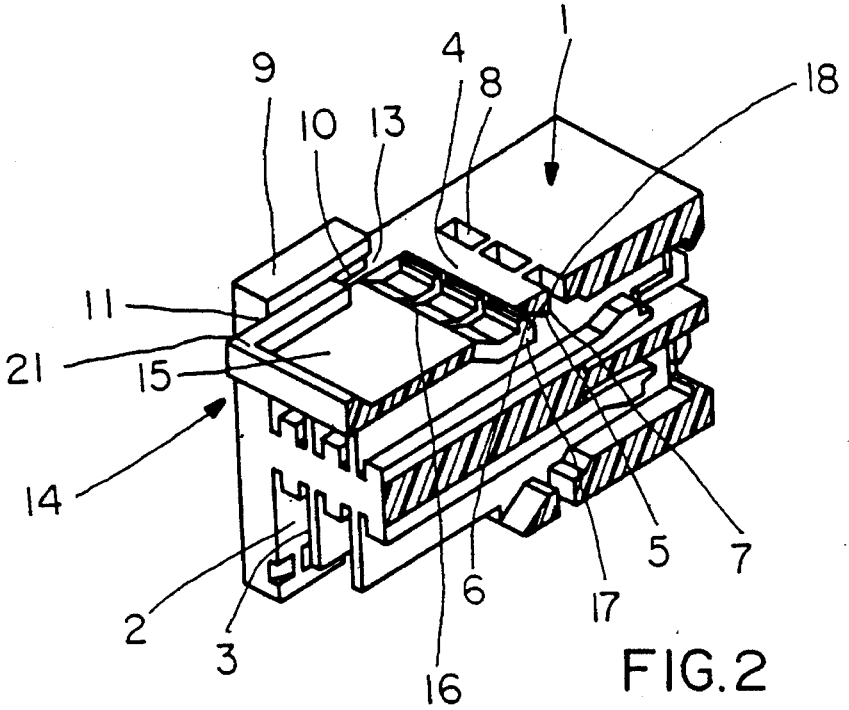
FIG. 2 is a similar partial perspective view of the electrical connector housing with the detachable spacer mounted in the primary position.

In FIG. 1 the housing 1 and the spacer 14 are shown as being separated. The spacer 14 is inserted in the housing 1 until it has reached the primary or provisional mounting position as shown in FIG. 2. Specifically, the locking arms 17 of the spacer 14 are inserted in the terminal mounting compartments 2 with the opposite guide projections 22 of the spacer 14 fitted in the inlet slots 11 of the opposite side walls 9. In this position the rear tapering surface of each guide projection 22 abuts the slanted surface of the inlet slot 11. When the spacer 14 is pushed, the opposite guide projections 22 ride over the stopper sections 12 and enter into the guide slots 10. The spacer 14 is then moved towards the rear of the connector 1 until the rear sides of the latching projections 18 of the locking arms 17 of the spacer 14 abut the front surfaces 6 of the lateral engagement pieces 5 of the top wall 4. Thus, the spacer 14 is mounted in the provisional mounting position as seen from the upper terminal mounting space of the housing 1 in FIGS. 2 and 4.

Thereafter, terminals 23 are inserted into the terminal mounting compartments 2. Terminals 23 are inserted into the terminal mounting compartments 2 moving towards the rear of the connector under the overlying spacer 14 which is retained in its provisional mounting position. In this position there remains a small space 25 between each terminal 23 and the overlying spacer 14 (although not shown in FIG. 4), and therefore each terminal 23 can move toward the final terminal-mounting position without interference with the overlying spacer 14. Frictionless insertion of terminals minimizes the insertion force required to mount terminals 23 in the terminal mounting compartments 2.

Thereafter, the spacer 14 is pushed toward the final spacer-mounting position. Specifically, the latching projections 18 of the locking arms 17 ride over the top surfaces 7 of the lateral engagement pieces 5 to engage slots 8. Thus, each locking arm 17 of the spacer 14 is individually engaged by a corresponding engagement slot 8. With this arrangement every locking arm 17 is held with the same locking force no matter how many terminals or locking arms there may be.

Figure 3:
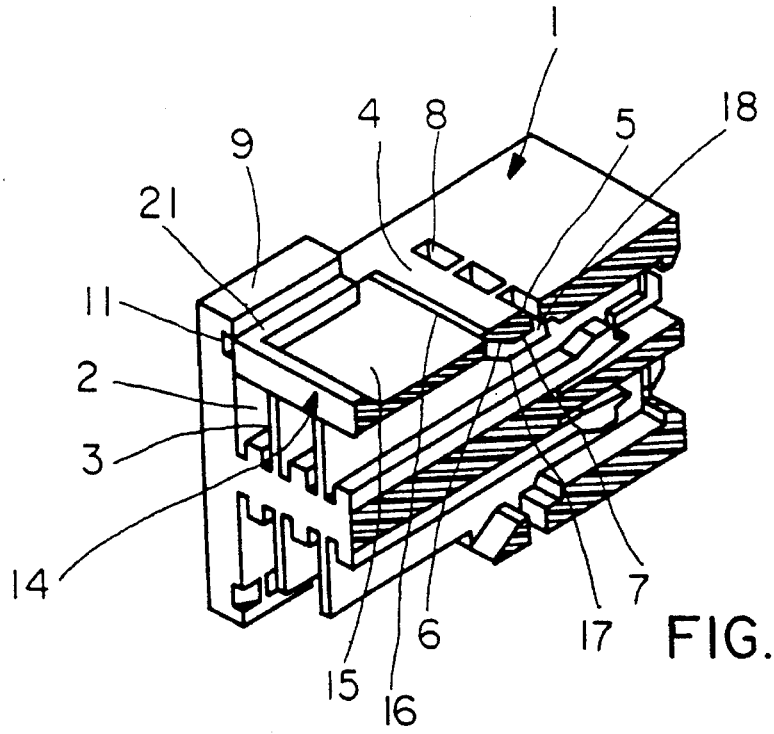
FIG. 3 is a similar partial perspective view of the electrical connector housing with the detachable spacer mounted in the final spacer-mounting position.
Figure 4:
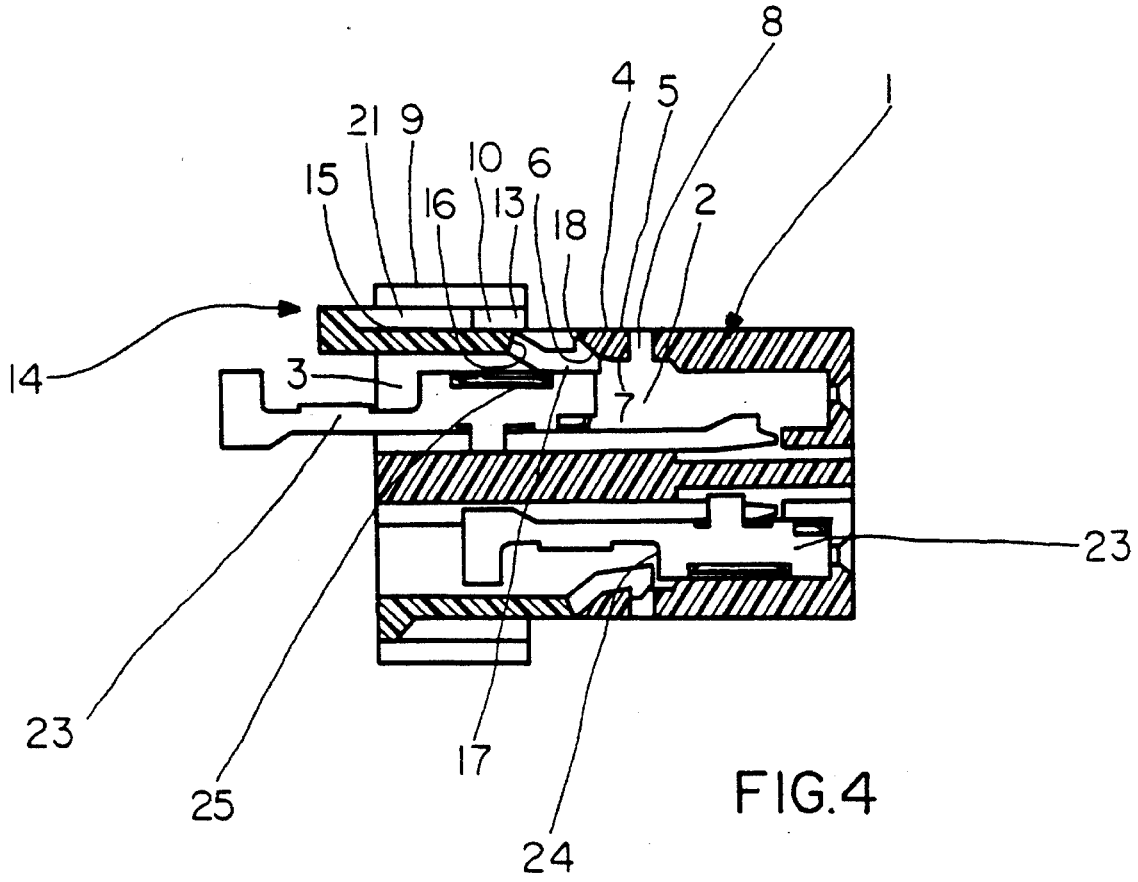
FIG. 4 is a longitudinal cross-section of the electrical connector housing showing: one detachable spacer in the primary mounting position and a terminal moving to the final terminal-mounting position in the upper terminal mounting space; and a detachable spacer and a terminal both in the final spacer-mounting and terminal-mounting positions in the lower terminal mounting space.
Figure 5:
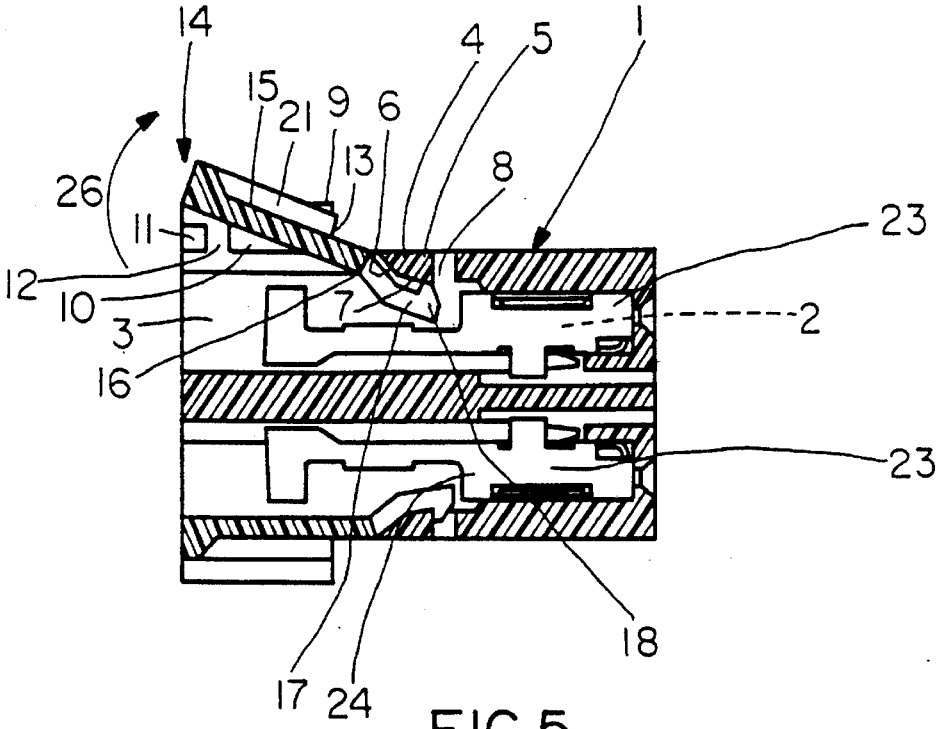
FIG. 5 is a longitudinal cross-section of the electrical connector housing showing a detachable spacer in its rotated position prior to removal of the terminals.
Figure 6:
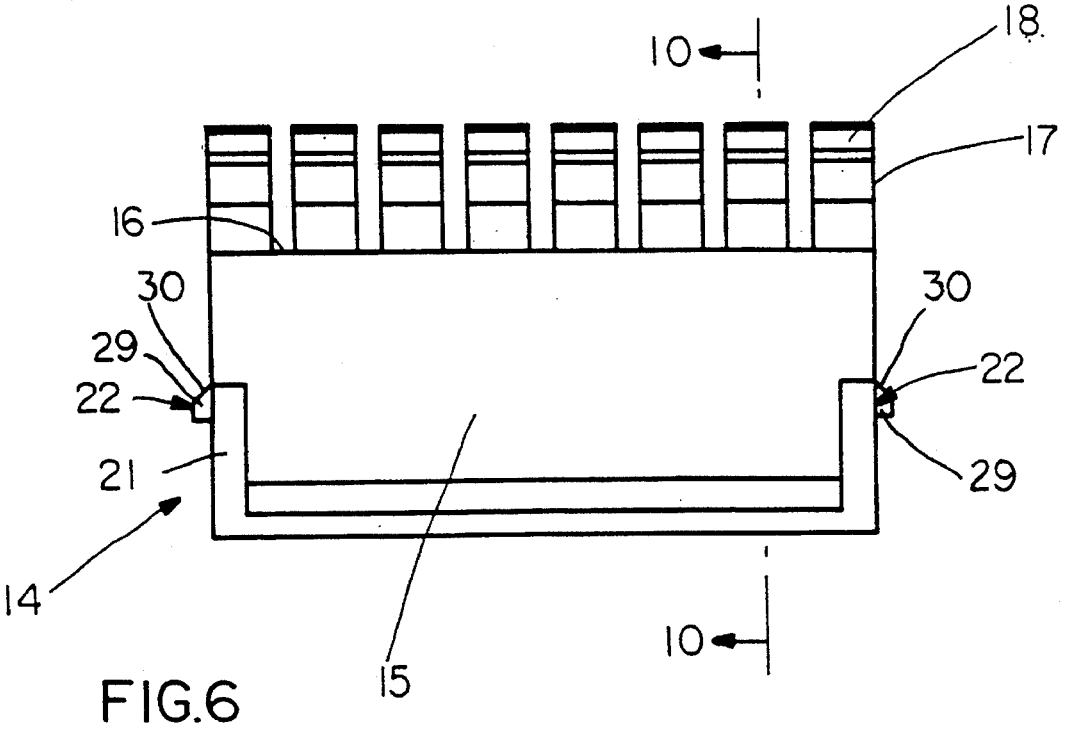
FIG. 6 is a top view of the detachable spacer.
Figure 7:
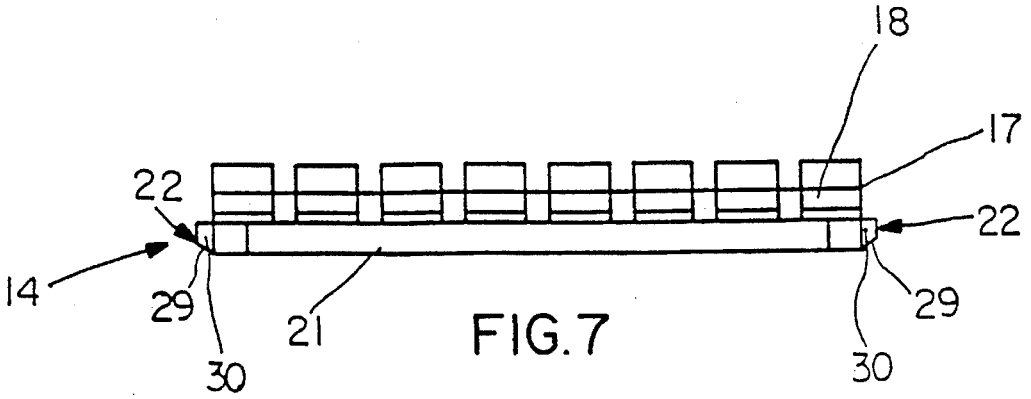
FIG. 7 is a front view of the detachable spacer.
Figure 8:
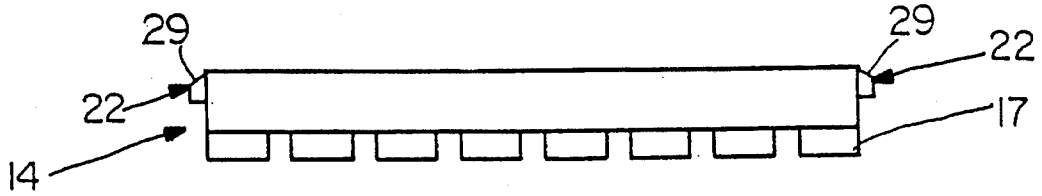
FIG. 8 is a rear view of the detachable spacer.
Figure 9:
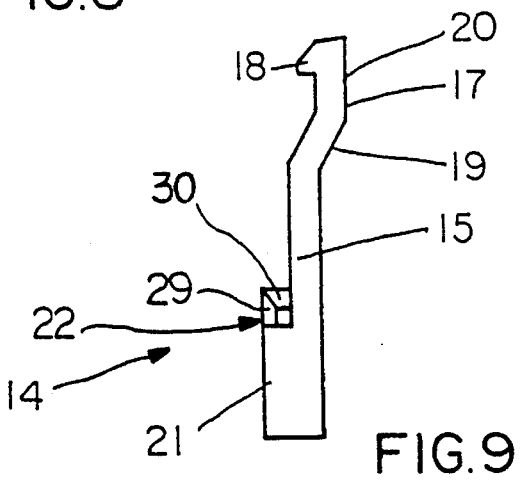
FIG. 9 is a side view of the detachable spacer.
Figure 10:
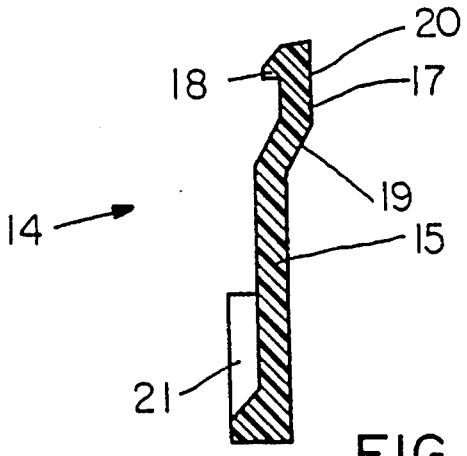
FIG. 10 is a longitudinal cross-section of the detachable spacer taken along the line 10—10 in FIG. 6.

The top surface 7 of the lateral engagement piece 5 is somewhat inclined up forward in the direction in which the terminal is made to advance, thus permitting the latching projection 18 of the locking arm 17 to abut the end surface 24 of the terminal 23 in the final terminal-mounting position, thereby preventing pulling out of the terminals 23 from the terminal mounting compartments 2, as best shown in the lower compartment of the connector housing 1 in FIGS. 3 and 4.

The method of removing the terminals 23 from the terminal mounting compartments 2 of the housing 1 for replacement or other purposes is described below. First, the spacer 14 is raised and rotated about a selected point in the vicinity of the rear part 16 of the base 15 of the spacer 14 as indicated by arrow 26 in FIG. 5. The movement disengages latching projections 18 of the locking arms 17 from the engagement slots 8. At the same time, the guide projections 22 are released from the open ends 13 of the guide slots 10 allowing the spacer 14 to be removed from the housing 1. The tapering surfaces 29 of the guide projections 22 allow the spacer 14 to be slipped off from the open ends 13 of the guide slots 10.

In any event no tools are required to remove the spacer 14 from the housing 1, and the wires (not shown) extending from the terminals will not interfere with the spacer when removed. After removal of the spacer 14 the terminals 23 can be removed from the terminal compartments of the housing, as shown in the upper terminal mounting space of the housing in FIG. 5.

In this particular embodiment the connector housing is described as having upper and lower terminal mounting spaces, but it should be understood that the connector can have a single terminal mounting space.

Figure 11:
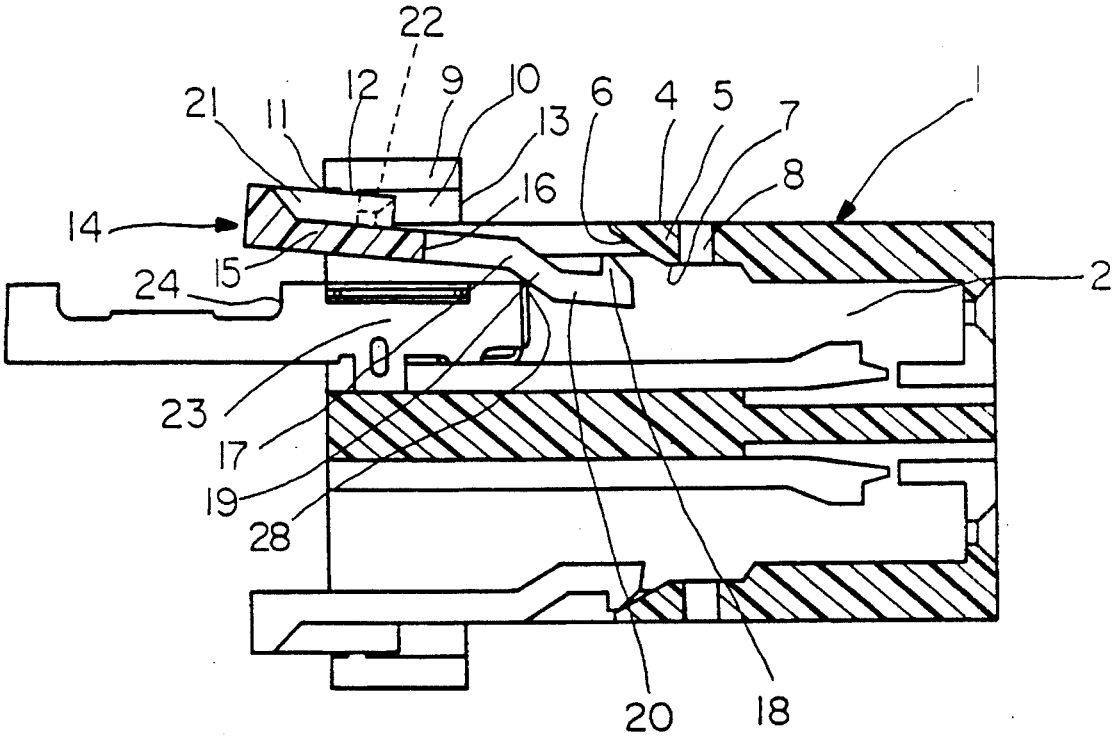
FIG. 11 is a longitudinal cross-section of an electrical connector according to another embodiment having a detachable spacer and the terminals both mounted in the primary position.
Figure 12:
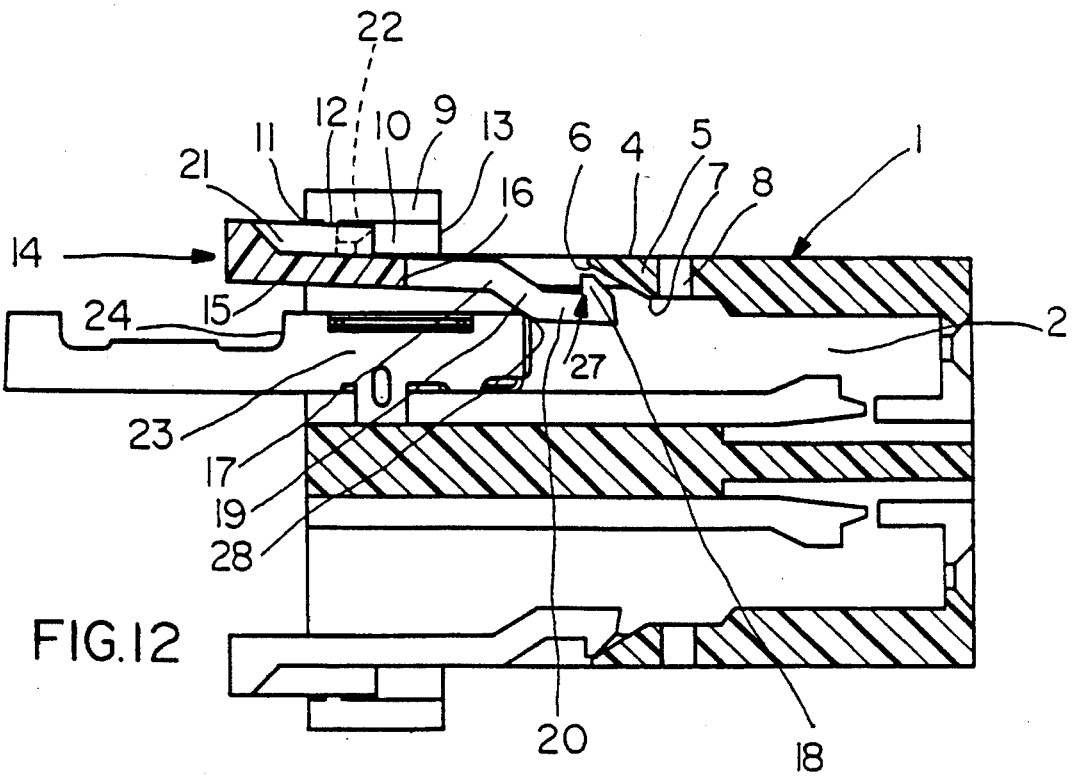
FIG. 12 is a longitudinal section similar to one in FIG. 11, but showing the terminal moved closer to the final terminal-mounting position.
Figure 13:
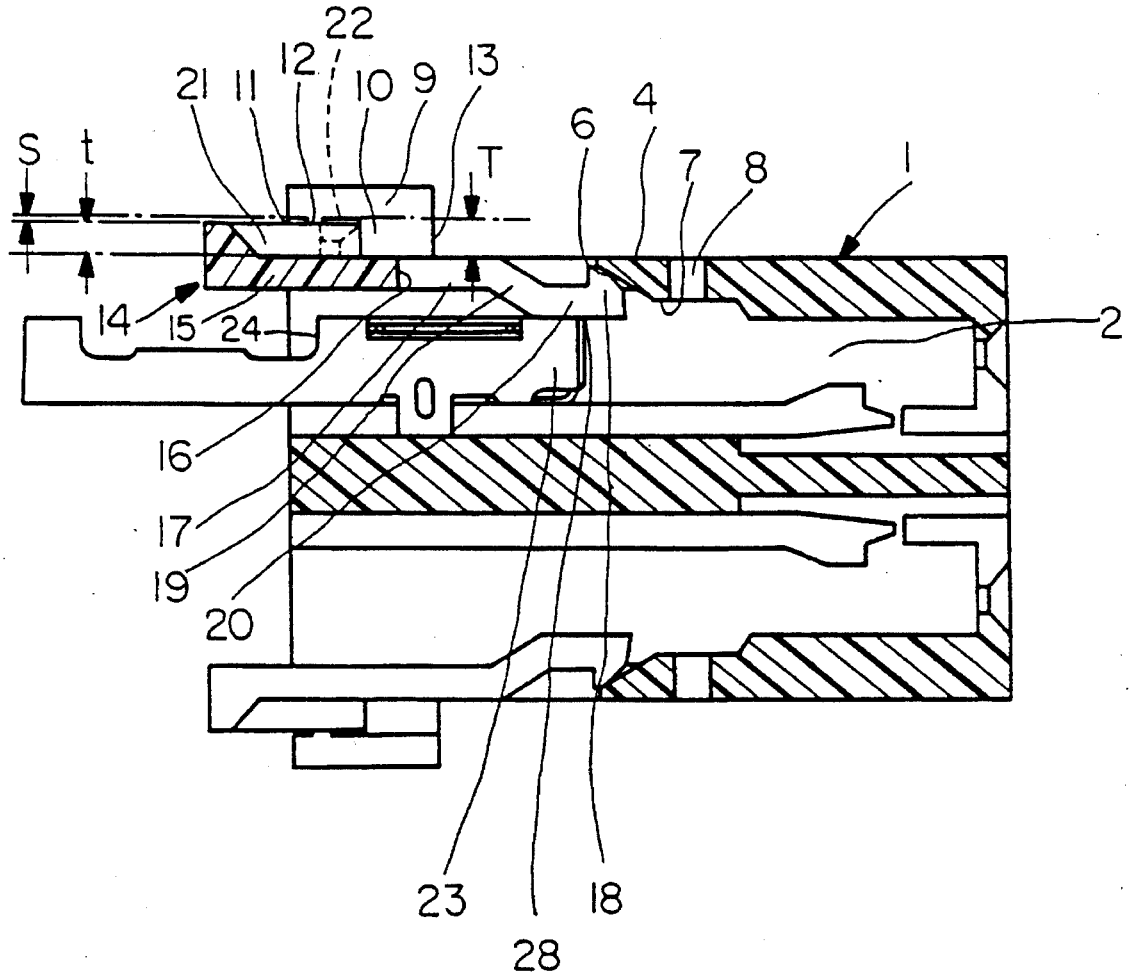
FIG. 13 is a longitudinal section similar to Fig. 12, but showing the terminal moved closer to the final terminal-mounting position.

Referring to FIGS. 11 to 13, an electrical connector 1 with two detachable spacers 14 is described according to a second embodiment of the subject invention.

Parts of the electrical connector 1 according to the second embodiment which are the same as parts of the electrical connector 1 according to the first embodiment are indicated by the same reference numerals in FIGS. 11 to 13, and descriptions of such parts are omitted.

As described above, in an electrical connector 1 according to the first embodiment, there is a small space or gap 25 between the terminals 23 and the overlying spacer 14 mounted in the provisional mounting position, thus allowing the terminals to be inserted into the connector housing without interference with the overlying spacer 14. In contrast to this, an electrical connector 1 according to the second embodiment is so constructed as to permit the spacer 14 in the provisional mounting position to float, i.e. ride on the terminals 23 when they move towards the final terminal-mounting position thereby preventing application of appreciable pressure on the terminals 23. The following description is directed to this feature. The width "T" of the guide slot 10 on either side wall of the housing 1 is determined to be larger than the thickness "t" of the guide projection 22 on either side of the spacer 14, thereby defining the gap "S"=T−t to be large enough to allow the spacer 14 to float. However, there may be other ways to implement floating structures. For instance, the shape of guide projections and the shape of guide slots, and the relative physical relation between the guide projection and the guide slot may be selected appropriately for the purpose.

In operation, the spacer 14 is inserted in the housing 1 with its opposite guide projections 22 in the guide slots 10 until it has reached the provisional mounting position as in the electrical connector according to the first embodiment. In this provisional position, however, the spacer 14 is inclined with the locking arms 17, extending into terminal compartments 2, as shown in FIG. 11. This inclination is caused by the space or gap "S" between the guide projections 22 and the guide slots 10 allowing the spacer 14 to incline by gravity. As a result the latching projections 18 of the locking arms 17 are located apart from the front surface of the lateral engagement piece 5.

As shown in FIG. 11, the terminals 23 are inserted in the terminal mounting compartments 2. Insertion of the terminals in the housing 1 will cause the abutting of the forward ends 28 of the terminals 23 on the slanted extensions 19 of the spacer 14, and subsequent movement of the terminals causes rising of the spacer 14 as indicated at 27 in FIG. 12. The floating spacer 14 does not apply an appreciable force on the terminals and thus should minimize incomplete mounting of the terminals 23.

Continued insertion of the terminals 23 moves the terminals 23 past the slanted extensions 19 until the locking arms 17 abut the front surface 6 of the lateral engagement piece 5 as seen from FIG. 13. Terminals 23 can then move toward the final terminal-mounting position without interference with the locking arms 17 of the spacer 14. After the terminals 23 reach the final terminal-mounting position, the spacer 14 may be pushed toward the final spacer-mounting position, just as in the electrical connector arrangement according to the first embodiment.

As may be understood from the above, advantageously no load is applied to the terminals 23 by the overlying spacer 14 when the terminals 23 are moved to the final terminal setting position, thus minimizing incomplete mounting of the terminals; all the locking arms 17 apply equal holding forces to the terminals; and simple rotating of the spacer 14 allows removal of the spacer 14 (and hence the terminals 23) from the housing 1 without requiring extra tools, or causing any interference with the wires extending from the terminals 23.

We claim:

1. An electrical connector with a terminal retaining spacer, comprising, a connector housing having top and a pair of side walls, a plurality of terminal receiving cavities extending therethrough to receive electrical terminals, the top wall having a plurality of apertures each communicating with a respective terminal receiving cavity the housing having a front opening and guide slots in the side walls to receive and guide the terminal retaining spacer, the terminal retaining spacer mounted to the front portion of the housing in two steps, first in provisionally engaged position and second in fully engaged position, the terminal retaining spacer has a base and a plurality of locking arms extending from a rear edge for insertion into the terminal retaining cavities, each arm terminating in a latching surface, a pair of guide projections extending from two opposite sides of the base each adapted to engage a respective guide slot on one of the side walls, wherein when the terminal retaining spacer is mounted to the front portion of the housing in the provisionally engaged condition, the base of the spacer is supported by the housing such that the locking arms are not in the terminal receiving cavities and the terminals may be inserted underneath the spacer without interfering with any portion of the spacer, and when the terminal retaining spacer is moved into the final-engaged condition the latching surfaces of the locking arms engage respective apertures in the top wall and a portion of the latching surfaces project into terminal receiving cavities to engage a locking surface on each terminal.

2. An electrical connector in accordance with claim 1, wherein the top wall covers only a portion of the housing and the terminal receiving cavities are separated by walls which support the terminal retaining spacer in the provisionally engaged position.

3. An electrical connector in accordance with claim 2, wherein the terminal retaining spacer when in fully-mounted position in combination with the top wall encloses the top of the housing.

4. An electrical connector in accordance with claim 1, wherein the guide slots and the guide projections are adapted such that guide projections exit from guide slots when the terminal retaining spacer is rotated about its rear edge whereby the latching projections disengage from the apertures in the top wall.

* * * * *